US010079443B2

(12) United States Patent
Costello et al.

(10) Patent No.: US 10,079,443 B2
(45) Date of Patent: Sep. 18, 2018

(54) INTERPOSER SOCKET AND CONNECTOR ASSEMBLY

(71) Applicants: TYCO ELECTRONICS CORPORATION, Berwyn, PA (US); TYCO ELECTRONICS JAPAN G.K., Kawasaki-shi (JP)

(72) Inventors: Brian Patrick Costello, Scotts Valley, CA (US); Naoki Hashimoto, Tokyo (JP)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 15/183,973

(22) Filed: Jun. 16, 2016

(65) Prior Publication Data

US 2017/0365947 A1 Dec. 21, 2017

(51) Int. Cl.
*H01R 13/24* (2006.01)
*H01R 12/58* (2011.01)

(52) U.S. Cl.
CPC ..... *H01R 13/2442* (2013.01); *H01R 12/585* (2013.01); *H01R 2201/20* (2013.01)

(58) Field of Classification Search
CPC .. H01R 12/7076; H01R 13/506; H01R 11/09; H01R 12/58; H01R 12/7005; H01R 12/714; H01R 12/716; H01R 12/718; H01R 12/721; H01R 12/724; H01R 12/737; H01R 12/75; H01R 12/771; H01R 12/774
See application file for complete search history.

(56) References Cited

U.S. PATENT DOCUMENTS

| | | | | |
|---|---|---|---|---|
| 3,356,983 | A | 12/1967 | O'Johnson | |
| 4,871,315 | A | 10/1989 | Noschese | |
| 4,948,379 | A | 8/1990 | Evans | |
| 5,199,896 | A | 4/1993 | Mosquera | |
| 5,219,293 | A | 6/1993 | Imamura | |
| 5,261,826 | A | 11/1993 | Leeb et al. | |
| 5,383,787 | A | 1/1995 | Switky et al. | |
| 5,716,226 | A | 2/1998 | Takahashi et al. | |
| 5,916,000 | A * | 6/1999 | Feldmeier | H01R 12/585 439/751 |
| 6,053,746 | A | 4/2000 | Yoshizawa | |
| 6,336,816 | B1 | 1/2002 | Yatskov et al. | |
| 6,497,581 | B2 * | 12/2002 | Slocum | H01R 12/57 439/591 |

(Continued)

*Primary Examiner* — Truc Nguyen

(57) ABSTRACT

Interposer socket includes a base substrate and a plurality of spring contacts coupled to the base substrate. Each of the spring contacts has an inclined section that extends away from a top side of the base substrate at a generally non-orthogonal orientation. The inclined section configured to be deflected toward the top side when an electronic module is mounted onto the interposer socket. The inclined section has a mating surface of the spring contact that is configured to engage the electronic module. The inclined section also includes first and second beam segments and a contact slot therebetween. The first and second beam segments extend in an oblique direction away from the top side. The contact slot has a slot width that is defined between inner edges of the first and second beam segments. The slot width increases as the contact slot extends in the oblique direction.

20 Claims, 8 Drawing Sheets

(56) References Cited

U.S. PATENT DOCUMENTS 6,537,086 B1 * 3/2003 MacMullin ..... H01R 23/688 439/79
6,659,802 B1 12/2003 Lwee
6,846,115 B1 1/2005 Shang et al.
6,971,887 B1 12/2005 Trobough
6,979,891 B2 12/2005 Wood et al.
6,984,130 B2 * 1/2006 Richter ..... H01R 13/2435 439/66
6,991,472 B2 * 1/2006 Du ..... H01R 13/2435 439/66
7,066,740 B2 * 6/2006 Audet ..... H01L 23/49811 257/E23.068
7,066,756 B2 6/2006 Lange et al.
7,275,936 B1 * 10/2007 Ju ..... H01R 13/2435 439/591
7,296,347 B2 * 11/2007 Antaya ..... H01R 13/04 156/276
7,407,408 B1 8/2008 Taylor
7,435,100 B2 * 10/2008 Chang ..... H01R 13/2435 439/66
7,530,815 B2 5/2009 Ju
7,654,847 B2 2/2010 Soubh et al.
7,891,983 B2 * 2/2011 Ichimura ..... H01R 13/2428 439/66
7,972,144 B2 * 7/2011 Chang ..... H01R 4/02 439/66
8,067,109 B2 * 11/2011 Zhang ..... H01M 2/30 429/100
8,118,602 B2 * 2/2012 Beaman ..... H01R 13/2407 439/66
8,167,644 B2 5/2012 Mason
8,172,615 B2 * 5/2012 Mason ..... H01R 12/714 439/108
8,188,594 B2 5/2012 Ganesan et al.
8,246,360 B1 * 8/2012 Tsai ..... H01R 12/55 439/66
8,308,491 B2 11/2012 Nichols et al.
8,382,487 B2 2/2013 Jeon et al.
8,398,429 B2 3/2013 Costello
8,500,458 B2 * 8/2013 Chang ..... H01R 13/2435 439/66
8,721,348 B2 5/2014 Costello
8,727,808 B2 5/2014 Mason et al.
8,851,932 B2 10/2014 Mason
8,867,231 B2 10/2014 Roitberg et al.
8,932,083 B2 1/2015 Ho
9,472,878 B2 10/2016 Costello et al.
9,559,446 B1 1/2017 Wetzel et al.
9,590,338 B1 3/2017 Schmitt et al.
2003/0064635 A1 * 4/2003 Ochiai ..... H01R 13/2435 439/856
2006/0141825 A1 * 6/2006 Nakagawa ..... H01R 13/112 439/78
2011/0294365 A1 * 12/2011 Wang ..... H01R 12/718 439/816
2012/0178298 A1 * 7/2012 Jin ..... H01R 12/714 439/626
2013/0267104 A1 * 10/2013 Chang ..... H01R 12/712 439/68
2016/0056554 A1 2/2016 Costello

* cited by examiner

INTERPOSER SOCKET AND CONNECTOR ASSEMBLY

BACKGROUND

The subject matter described and/or illustrated herein relates generally to connector assemblies for electronic modules.

Competition and market demands have continued the trend toward smaller and higher performance (e.g., faster) electrical systems and devices. The desire for higher density electrical systems and devices has led to the development of land grid array (LGA) electronic assemblies. An LGA electronic assembly includes an electronic module and an interposer socket that is configured to be positioned between the electronic module and the electrical component (e.g., circuit board). The interposer socket communicatively couples the electronic module and the electrical component. For example, the electronic module may have a mounting side that includes an array of conductive pads. The interposer socket may include an array of spring contacts positioned along a top side of the interposer socket. Each spring contact has a mating surface that engages a corresponding conductive pad of the electronic module at a mating interface.

Conventional spring contacts for LGA assemblies, however, can exhibit a high impedance at the mating interfaces between the spring contacts and the respective conductive pads. For certain applications, such as high speed or high frequency applications, the difference between the impedance at the mating interfaces and the characteristic impedance of the system can substantially degrade signal integrity. Modifying the LGA assembly to reduce this impedance discontinuity, however, can create other challenges or cause unwanted effects.

Accordingly, there is a need for an interposer socket that reduces the impedance discontinuity at the mating interfaces between the electronic module and the electronic component (e.g., circuit board).

BRIEF DESCRIPTION

In an embodiment, an interposer socket is provided that includes a base substrate having opposite top and bottom sides and a plurality of spring contacts coupled to the base substrate. Each of the spring contacts has an inclined section that extends away from the top side at a generally non-orthogonal orientation with respect to the top side. The inclined section configured to be deflected toward the top side when an electronic module is mounted onto the interposer socket. The inclined section has a mating surface of the spring contact that is configured to engage the electronic module. The inclined section also includes first and second beam segments and a contact slot therebetween. The first and second beam segments extend in an oblique direction away from the top side. The contact slot has a slot width that is defined between inner edges of the first and second beam segments. The slot width increases as the contact slot extends in the oblique direction.

In an embodiment, an interposer socket is provided that includes a base substrate having opposite top and bottom sides and a plurality of spring contacts coupled to the base substrate. Each of the spring contacts has an inclined section that extends away from the top side at a generally non-orthogonal orientation with respect to the top side. The inclined section configured to be deflected toward the top side when an electronic module is mounted onto the interposer socket. The inclined section has a mating surface of the spring contact that is configured to engage the electronic module. The inclined section includes first and second beam segments and a contact slot therebetween. The first and second beam segments have respective outer edges and extend in an oblique direction away from the top side. A maximum width of the inclined section is defined between the outer edges. The maximum width is essentially constant for at least a majority of the inclined section.

In an embodiment, a connector assembly is provided that includes an electronic module configured to receive input data signals, process the input data signals, and provide output data signals. The electronic module has a module side that includes module contacts. The connector assembly also includes an interposer socket having a base substrate with opposite top and bottom sides. The interposer socket also includes a plurality of spring contacts coupled to the base substrate. Each of the spring contacts has an inclined section that extends away from the top side at a generally non-orthogonal orientation with respect to the top side. The inclined section is configured to be deflected toward the top side when the electronic module is mounted onto the interposer socket. The inclined section has a mating surface of the spring contact that is configured to engage a corresponding module contact of the electronic module. The inclined section includes first and second beam segments and a contact slot therebetween. The first and second beam segments extend in an oblique direction away from the top side.

In some embodiments, adjacent inclined sections of at least some of the spring contacts form working gaps between corresponding outer edges of the adjacent inclined sections. The working gaps may be essentially constant between the corresponding outer edges of the adjacent inclined sections.

In some embodiments, the contact slot has a slot width that is defined between inner edges of the first and second beam segments. The slot width may increase as the contact slot extends in the oblique direction.

In some embodiments, the first and second beam segments have outer edges that define a maximum width of the inclined section therebetween. The maximum width of the inclined section may be essentially constant as the slot width increases.

DETAILED DESCRIPTION

Figure 2:
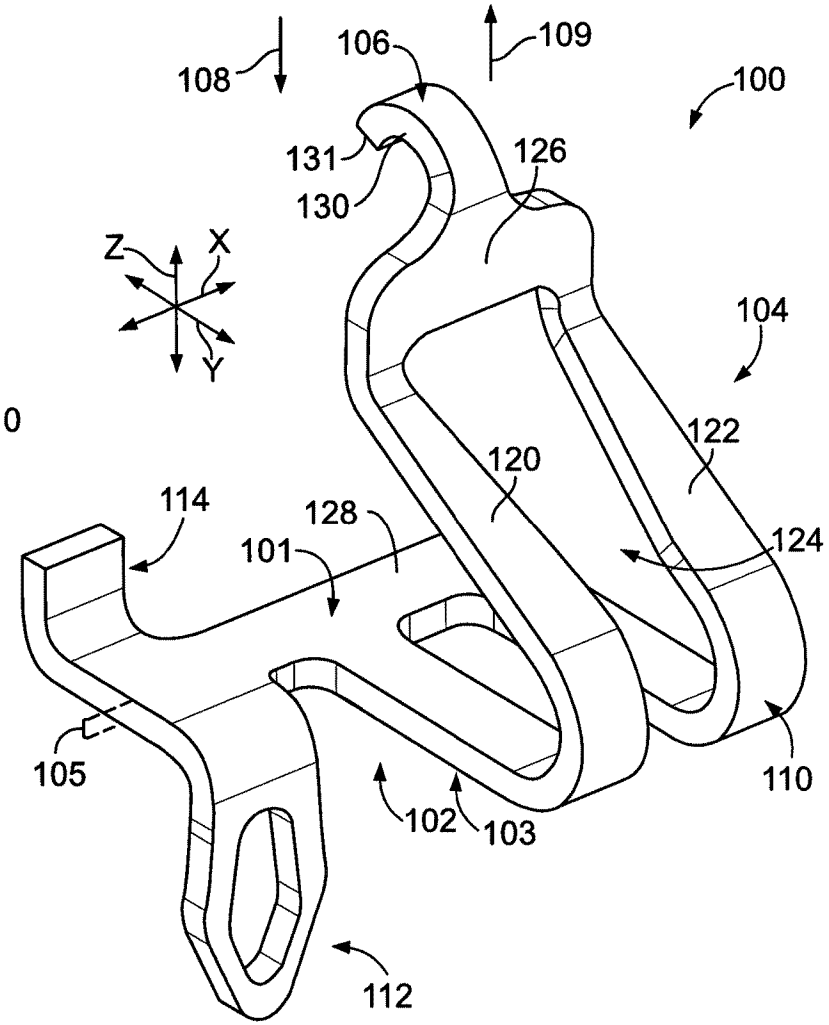
FIG. 2 is a rear perspective view of the spring contact of FIG. 1.

Embodiments set forth herein include spring contacts, interposer socket s that include such spring contacts, and connector assemblies that utilize such interposer sockets. Particular embodiments may include or be related to area grid array assemblies, such as land grid array (LGA) assemblies or ball grid array (BGA) assemblies. For example, embodiments may be configured to communicatively couple an electronic module (e.g., integrated circuit) and a printed circuit board. Although the spring contacts are described with reference to communicatively coupling an electronic module and a printed circuit board, it should be understood that the spring contacts may be used in other applications that electrically couple two components.

Embodiments may be configured to control impedance at a mating region between an interposer socket and one of the electrical components. For example, the interposer sockets set forth herein include spring contacts having inclined sections that are capable of being deflected along a Z-axis. The inclined sections are deflected when the electrical component is mounted onto the interposer socket. The mating surfaces of the inclined sections engage the electrical component at respective mating interfaces. Customer (or industry) specifications may require that the inclined sections have certain mechanical characteristics. For example, the specifications may require that the inclined sections are deflected a certain distance along the Z-axis when a designated force is applied. Embodiments may reduce an impedance discontinuity that exists between the mating interfaces and the characteristic impedance of the system while also satisfying the mechanical characteristics. In particular embodiments, air gaps that exists between adjacent inclined sections are reduced thereby reducing the impedance discontinuity.

The spring contacts, interposer sockets, and connector assemblies may be particularly suitable for high-speed communication systems. For example, the connector assemblies described herein may be high-speed connectors that are capable of transmitting data at a data rate of at least about five (5) gigabits per second (Gbps), at least about 10 Gbps, at least about 20 Gbps, at least about 40 Gbps, at least about 56 Gbps, or more.

FIGS. 1-5 illustrate different views of a spring contact 100 formed in accordance with an embodiment. The spring contact 100 may be used to electrically connect two electrical components. For example, the spring contact 100 may be mechanically and electrically coupled to a base substrate, such as a circuit board or dielectric frame, and be used to electrically connect an electronic module to a larger circuit board. FIGS. 11-14 illustrate one example of an interposer socket that may include an array of spring contacts. It should be understood, however, that the spring contact 100 may be used in other applications. For reference, the spring contact 100 is oriented with respect to mutually perpendicular X, Y, and Z axes.

The spring contact 100 may be stamped and formed from a conductive sheet material (e.g., copper alloy) having opposite side surfaces 101, 103. The spring contact 100 has a thickness 105 defined between the side surfaces 101, 103. The thickness 105 is essentially constant throughout the entire spring contact 100 in FIGS. 1-5, but it is contemplated that the thickness may vary in other embodiments.

In the illustrated embodiment, the spring contact 100 includes a base section 102 and an inclined section 104. The inclined section 104 has a mating surface 106 that is configured to engage an electrical contact (e.g., contact pad) of another electrical component, such as an electronic module (not shown). The electronic module may be similar or identical to the electronic module 306 (shown in FIG. 13). In FIGS. 1-5, the spring contact 100 is in an unengaged or relaxed condition. The inclined section 104 is configured to be deflected in a mounting direction 108 that is parallel to the Z-axis. The mounting direction 108 is toward the base section 102 in the illustrated embodiment.

The base section 102 and the inclined section 104 are coupled to each other at a joint 110. The inclined section 104 represents a portion of the spring contact 100 that moves or flexes about the joint 110 and with respect to the base section 102. The base section 102 represents a portion of the spring contact 100 that supports the inclined section 104. In some embodiments, the base section 102 engages a surface when operably coupled to the base substrate that supports the base section 102. Optionally, the base section 102 may directly engage a conductive surface (not shown). For example, the base section 102 may be soldered, welded, or otherwise mechanically and electrically engaged to a conductive surface. The base section 102 may have a fixed position during operation. In other embodiments, however, the base section 102 may be permitted to move relative to the base substrate.

As shown, the base section 102 may include a compliant pin 112 that is configured to mechanically engage a surface of the base substrate. For example, in the illustrated embodiment, the compliant pin 112 is an eye-of-needle pin that may be inserted into a thru-hole (not shown), such as the thru-hole 324 (shown in FIG. 12). The compliant pin 112 is configured to engage and be compressed between opposing portions of the surface that defines the thru-hole, whereby the compliant pin exerts a reaction force on the surface of the thru-hole that effectively couples the compliant pin 112 to the base substrate. In an exemplary embodiment, the compliant pin 112 secures the spring contact 100 in a substantially fixed position with respect to the base substrate. In other embodiments, the compliant pin 112 may mechanically and electrically couple the spring contact 100 to the base substrate.

Also shown, the base section 102 may include a strip remnant 114. In some embodiments, the spring contact 100 is stamped-and-formed to have the shape that is shown and described herein. During manufacture, working blanks (not shown) may be coupled to a common carrier strip. While remaining secured to the carrier strip, the working blanks may be stamped-and-formed to essentially provide the spring contact 100. The working blanks may be separated from the common carrier strip by, for example, stamping or etching a bridge that connects the working blank to the carrier strip. The strip remnant 114 may be formed by this separating process.

Figure 3:
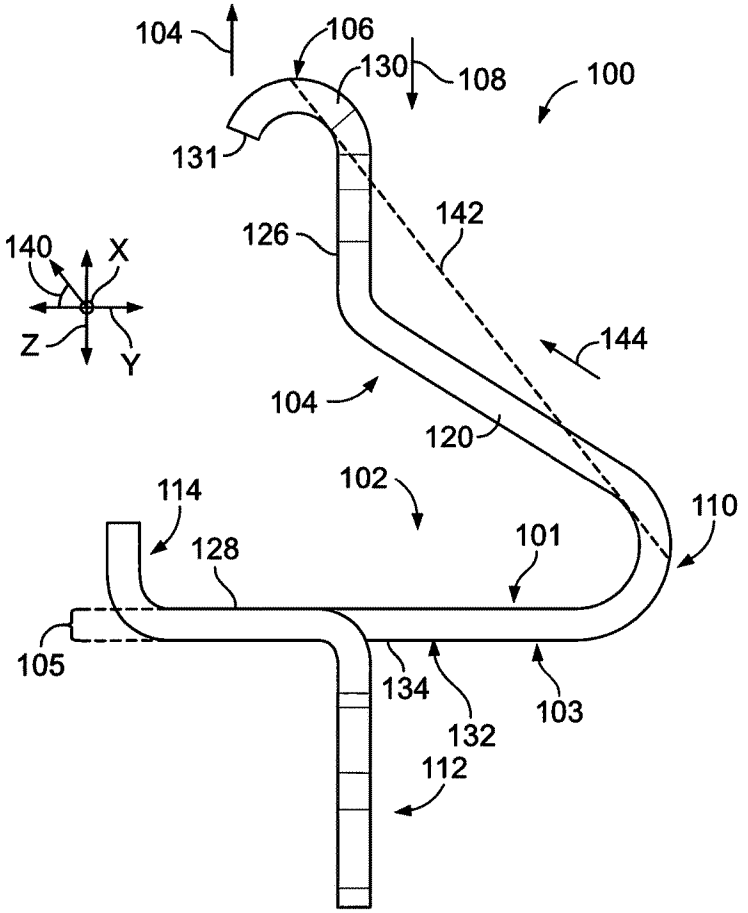
FIG. 3 is a side view of the spring contact of FIG. 1.

The spring contact 100 also includes a first beam segment 120 and a second beam segment 122 (not shown in FIG. 3)

that are separated by a contact slot 124 therebetween (not shown in FIG. 3). In the illustrated embodiment, the first and second beam segments 120, 122 form a portion of the base section 102 and a portion of the inclined section 104. The contact slot 124 extends through the base section 102 and the inclined section 104.

The first and second beam segments 120, 122 are joined through a contact bridge 126 of the inclined section 104. The contact bridge 126 may be proximate to the mating surface 106 as shown in FIGS. 1-5. In other embodiments, the contact bridge 126 may include the mating surface 106. Such an embodiment is shown in FIGS. 6-10. The first and second beam segments 120, 122 are also joined through a contact bridge 128 of the base section 102. The contact slot 124 extends directly between the contact bridges 126, 128. In the illustrated embodiment, the contact slot 124 has a path that is essentially two-dimensional and extends parallel to a YZ plane. It is contemplated, however, that the path may be three-dimensional and extend partially along the X axis.

In the illustrated embodiment, the inclined section 104 of the spring contact 100 includes a mating finger 130 that projects from the contact bridge 126. The mating finger 130 has a curved contour that provides the mating surface 106. The mating surface 106 faces essentially in a mating direction 109 along the Z axis that is opposite the mounting direction 108. The mating finger 130 may curve from the contact bridge 126 to a distal end or tip 131 (not shown in FIG. 4 or FIG. 5) of the mating finger 130. As shown, the mating finger 130 may extend from a central region of the contact bridge 126.

With respect to FIG. 3, the base section 102 includes a bottom surface 132 that is a portion of the side surface 103 along the base section 102 that faces in the mounting direction 108. The bottom surface 132 is configured to be seated onto a top side (not shown) of the base substrate. For instance, the bottom surface 132 may engage a conductive pad of the base substrate. The portion of the base section 102 that includes the bottom surface 132 may be referred to as a seat portion 134. The seat portion 134 extends parallel to an XY plane.

As shown in FIG. 3, the inclined section 104 has a generally non-orthogonal orientation with respect to the base section 102 or with respect to the seat portion 134. For embodiments in which the spring contact 100 is coupled to a base substrate, the inclined section 104 may have a generally non-orthogonal orientation with respect to the top side of the base substrate. As used herein, the phrase "generally non-orthogonal orientation" permits one or more portions of the inclined section to extend parallel or perpendicular to the referenced element (e.g., base section, seat portion, or top side). However, an inclined section is not required to have linear portions. For example, the inclined section 404 shown in FIGS. 16 and 17 curves throughout but has a generally non-orthogonal orientation with respect to the base section. With respect to FIG. 3, the non-orthogonal orientation is represented by a line 142 drawn from the joint 110 to the mating surface 106. An angle 140 between the line 142 and the XY plane (or the base section 102 or the seat portion 134) is about 60 degrees. It should be understood that the angle 140 may have other values (e.g., 40-85 degrees). Nonetheless, the non-orthogonal orientation shown in FIG. 3 allows the contact bridge 126 to extend perpendicular to the XY plane and allows a portion of the mating finger 130 to extend generally along the XY plane. The non-orthogonal orientation of the inclined section 104 permits the inclined section 104 to be deflected in the mounting direction 108.

Also shown in FIG. 3, the first and second beam segments 120, 122 extend in an oblique direction 144 away from the base section 102 or the bottom surface 132. The oblique direction 144 may also be described as extending away from the top side (not shown) of the base substrate when the spring contact 100 is coupled to the base substrate. The oblique direction 144 may form an angle with respect to the XY plane that is approximately equal to the angle 140.

Figure 5:
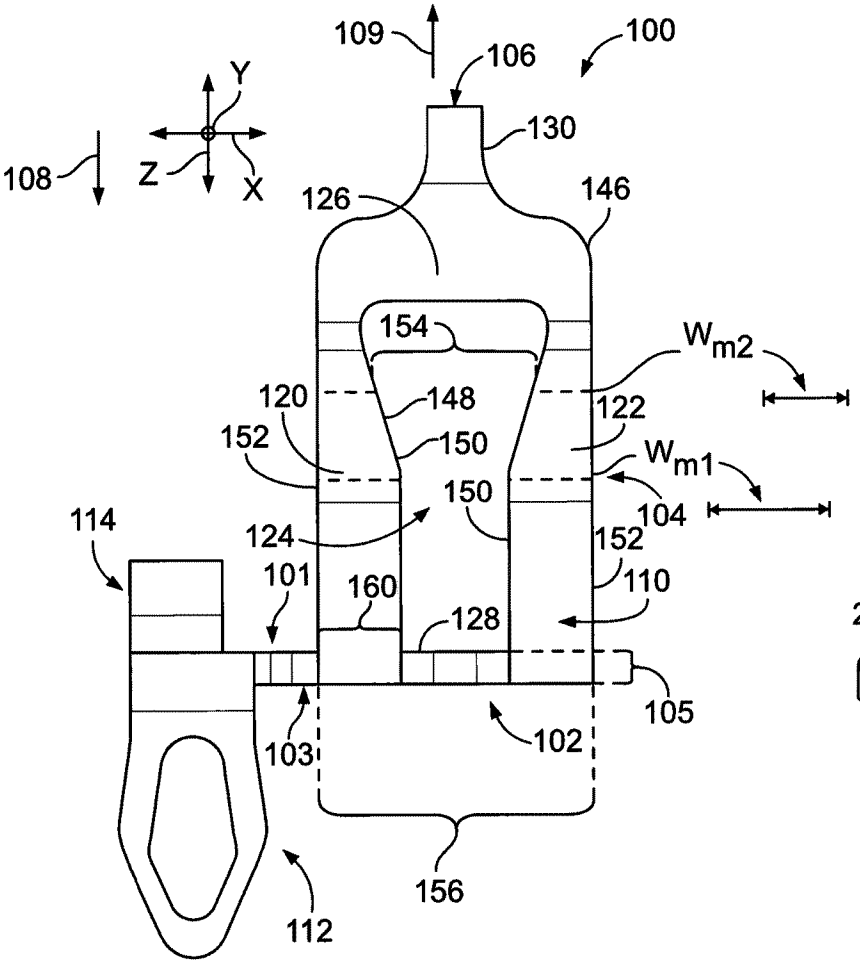
FIG. 5 is a back view of the spring contact of FIG. 1.
Figure 8:
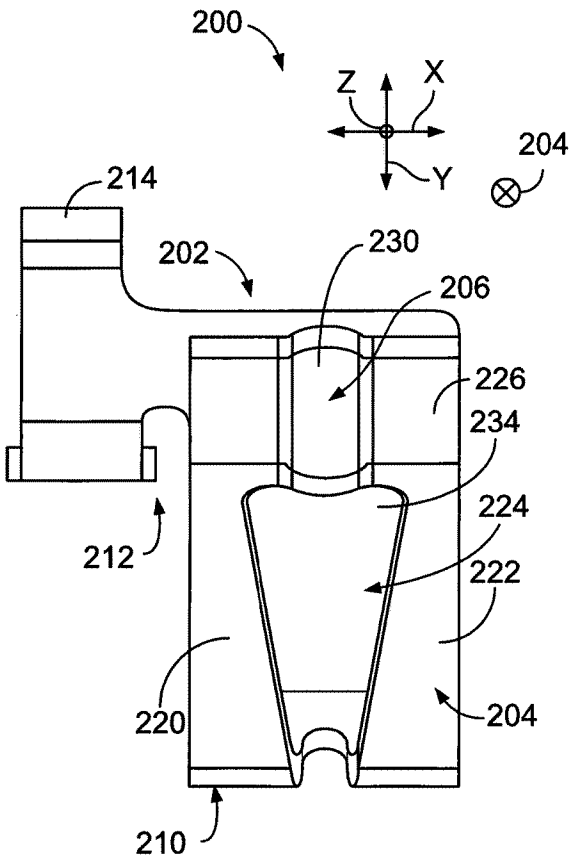
FIG. 8 is a top-down view of the spring contact of FIG. 6.
Figure 7:
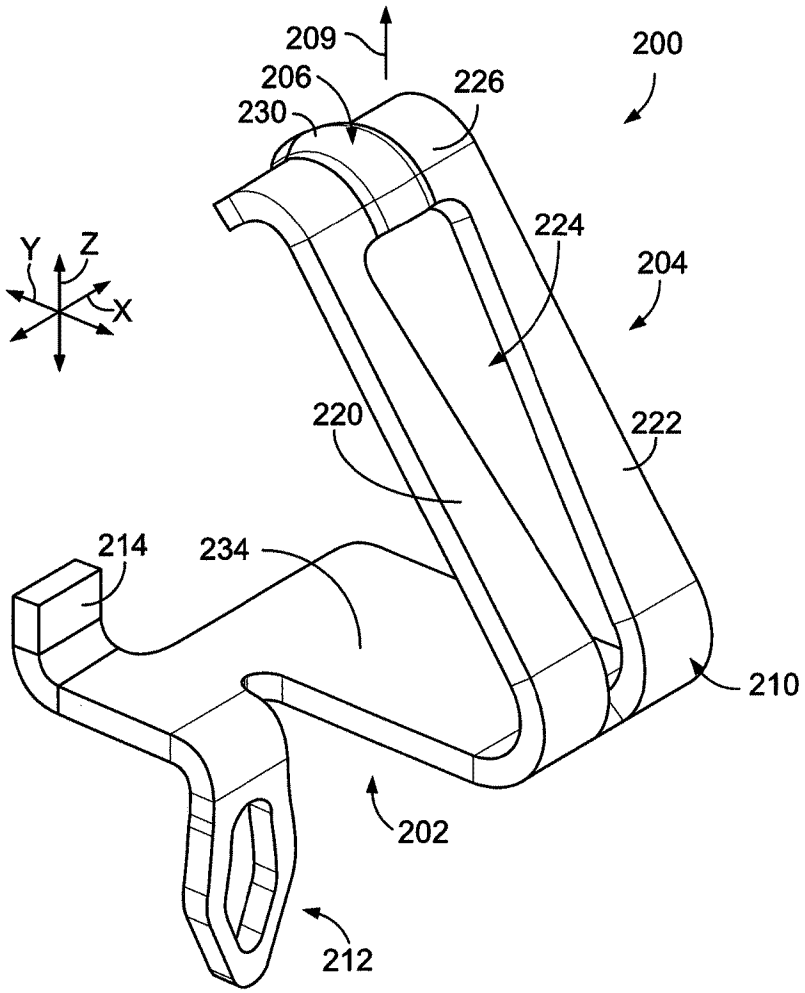
FIG. 7 is a rear perspective view of the spring contact of FIG. 6.

Turning to FIG. 5, the spring contact 100 has an outer contact edge 146 and an interior slot edge 148. The contact slot 124 is defined by the interior slot edge 148. Each of the first and second beam segments 120, 122 has an inner edge portion 150 and an outer edge portion 152. In the illustrated embodiment, the inner edge portions 150 are portions of the interior slot edge 148, and the outer edge portions 152 are portions of the outer contact edge 146. The inner edge portions 150 are hereinafter referred to as the inner edges, and the outer edge portions 152 are hereinafter referred to as the outer edges.

Each of the first and second beam segments 120, 122 has a beam width 160 that is defined between the respective inner edge 150 and the respective outer edge 152. The beams widths 160 decrease along the inclined section 104 as the first and second beam segments 120, 122 extend in the oblique direction 144 (FIG. 3). In particular embodiments, the beams widths 160 are essentially constant through the base section 102 and the joint 110, but decrease as the first and second beam segments 120, 122 extend through the inclined section 104 between the joint 110 and the contact bridge 126. As used herein, the term "essentially constant" means the dimension is unchanged for nearly an entirety of the referenced section or portion of the spring contact. The term permits minor deviations that occur due to manufacturing tolerances.

The inner edges 150 of the first and second beam segments 120, 122 generally oppose each other with the contact slot 124 therebetween. The contact slot 124 has a slot width 154 that is defined between the inner edges 150 of the first and second beam segments 120, 122. The slot width 154 increases along the inclined section 104 as the first and second beam segments 120, 122 extend in the oblique direction 144 (FIG. 3). In particular embodiments, the slot width 154 is essentially constant through the base section 102 and the joint 110, but increases as the first and second beam segments 120, 122 extend through the inclined section 104 between the joint 110 and the contact bridge 126.

Also shown in FIG. 5, the outer edges 152 of the first and second beam segments 120, 122 define a maximum width 156 of the inclined section 104 therebetween. The maximum width 156 of the inclined section 104 is essentially constant as the inclined section 104 extends from the joint 110 toward the mating surface 106. The joint 110 has the maximum width 156 throughout, and the base section 102 may have the maximum width 156 for at least a portion of the base section 102.

In particular embodiments, the maximum width 156 is essentially constant as the inclined section 104 extends in the oblique direction 144 (FIG. 1) and as the slot width 154 increases. For example, the maximum width 156 is maintained for the entire inclined section 104, except for the mating finger 130. The maximum width 156 is essentially constant through the first and second beam segments 120, 122.

For at least a portion of the spring contact 100, the maximum width 156 is essentially constant as the slot width 154 increases. As such, the inclined section 104 has a material width (reference particularly at $W_{M1}$ and $W_{M2}$) that decreases as the first and second beam segments 120, 122 extend in the oblique direction 144. A material width represents a width of contact material of the first and second beam segments less (or minus) the contact slot therebetween. The material width may also be determined by combining the respective beam widths of the first and second beam segments at a particular cross-section. For example, FIG. 5 indicates the material width $W_{M1}$ at a first cross-section and a material width $W_{M2}$ at a second cross-section. The material width $W_{M1}$, which is closer to the joint 110 or the base section 102, is greater than the material width $W_{M2}$, which is closer to the mating finger 130.

The material width corresponds to an amount of material that must bend when the inclined section 104 is deflected. The amount of material at a given cross-section is determined by the material width and the thickness 105. As previously described, the thickness 105 of the spring contact 100 is essentially constant. Mechanical characteristics at a designated cross-section of the inclined section 104 may be determined by (or a function of) the material width at the designated cross-section. As the material width decreases, the resistance to bending or flexing decreases. As the material width increases, the resistance to bending or flexing increases. The material width of the inclined section 104 may be configured to provide designated mechanical properties.

Figure 1:
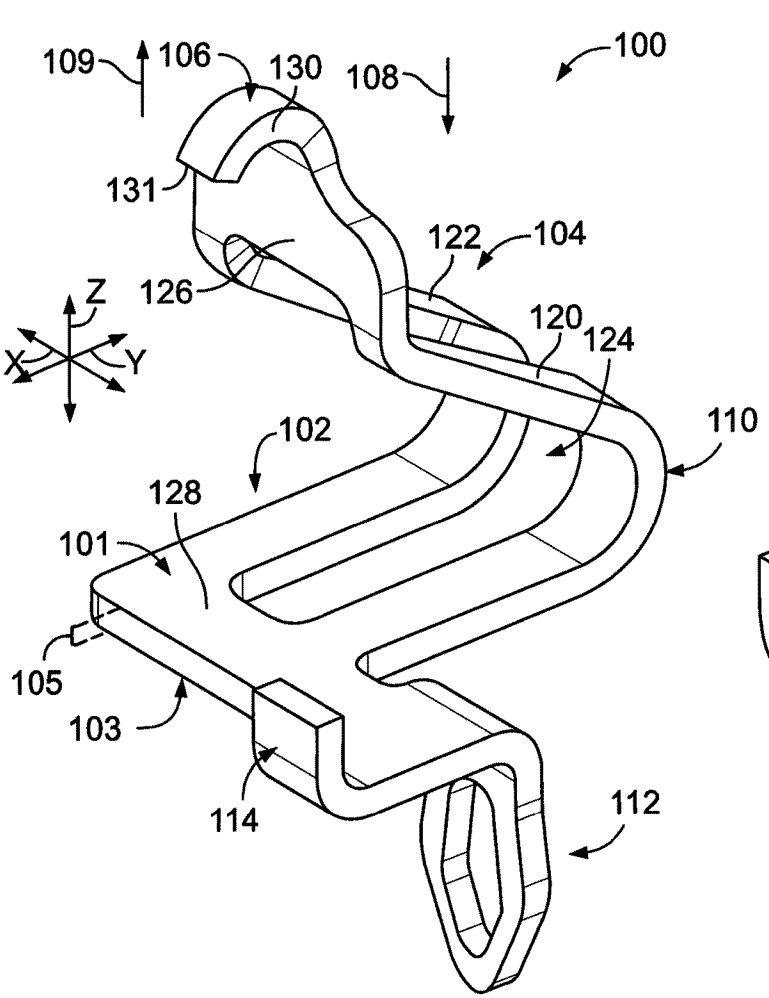
FIG. 1 is a front perspective view of a spring contact in accordance with an embodiment.
Figure 4:
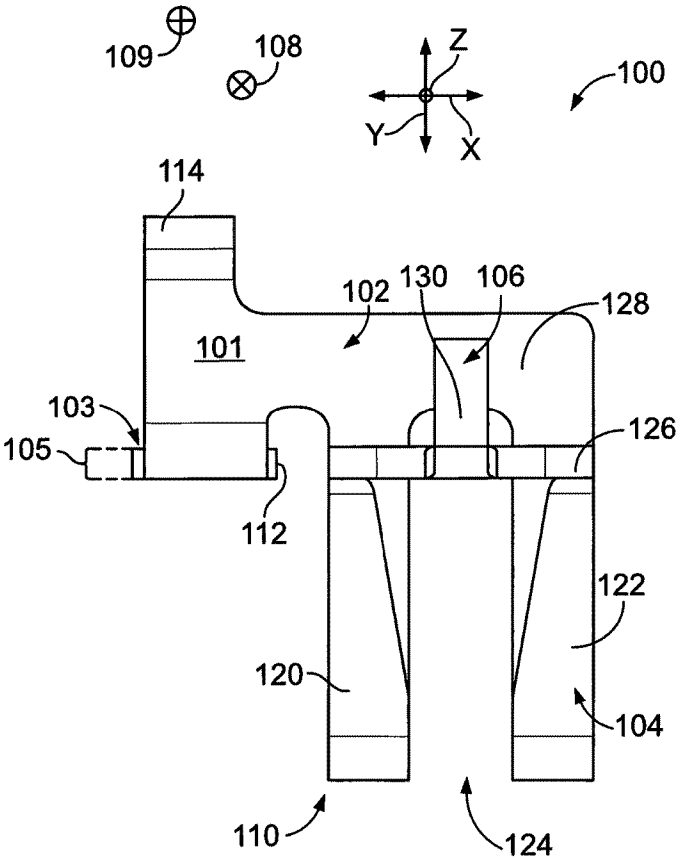
FIG. 4 is a top-down view of the spring contact of FIG. 1.

FIGS. 6-10 illustrate different views of a spring contact 200 in accordance with an embodiment. For reference, the spring contact 200 is oriented with respect to mutually perpendicular X, Y, and Z axes. The spring contact 200 may include features that are similar or identical to the spring contact 100 (FIG. 1). For example, the spring contact 200 includes a base section 202 and an inclined section 204. The inclined section 204 has a mating surface 206 that is configured to engage an electrical contact 307 (e.g., contact pad) (shown in FIG. 13) of an electronic module 306 (shown in FIG. 13). The base section 202 and the inclined section 204 are coupled to each other at a joint 210. As shown, the base section 202 includes a compliant pin 212 that is similar or identical to the compliant pin 112 (FIG. 1). The base section 202 may also include a strip remnant 214.

Figure 10:
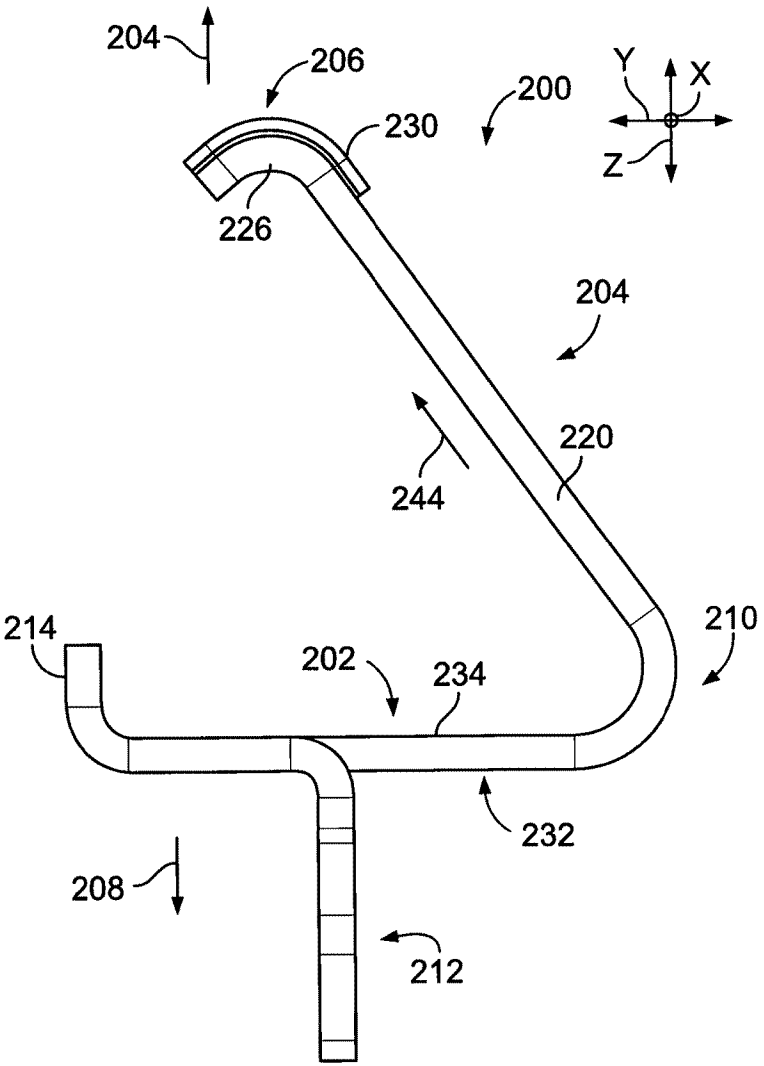
FIG. 10 is a side view of the spring contact of FIG. 6.

The spring contact 200 also includes a first beam segment 220 and a second beam segment 222 (not shown in FIG. 10) that are separated by a contact slot 224 therebetween (not shown in FIG. 10). The first and second beam segments 220, 222 form a portion of the inclined section 204 and a portion of the joint 210. Unlike the first and second beam segments 120, 122 (FIG. 1), the first and second beam segments 220, 222 do not form a portion of the base section 202. The base section 202 includes a seat portion 234, the compliant pin 212, and the remnant 214. The seat portion 234 has a planar body that is configured to be mounted onto a top side 320 (shown in FIG. 11) of the base substrate 304.

The first and second beam segments 220, 222 are joined through a contact bridge 226 of the inclined section 204. The contact bridge 226 includes the mating surface 206. The first and second beam segments 220, 222 are also joined at the joint 210 or at the base section 202. The contact slot 224 extends directly between the contact bridge 226 and the joint 210. In the illustrated embodiment, the contact slot 224 has a path that is essentially linear and extends parallel to a YZ plane.

The mating surface 206 faces essentially in a mating direction 209 that is parallel to the Z-axis. In the illustrated embodiment, the contact bridge 226 of the inclined section 204 includes a mating ridge 230. The mating ridge 230 is a stamped protrusion that provides the mating surface 206. More specifically, the contact bridge 226 is stamped to form the protrusion that constitutes the mating ridge 230. Similar to the mating surface 106 (FIG. 1) of the mating finger 130 (FIG. 1), the mating surface 206 is a localized area of the mating ridge 230 that has a greater elevation than the surrounding area such that the electronic module 306 (FIG. 13) engages the mating surface 206 before engaging the surrounding area.

With respect to FIG. 10, the seat portion 234 includes a bottom surface 232 that faces in a mounting direction 208. The inclined section 204 has a generally non-orthogonal orientation with respect to the base section 202 or with respect to the seat portion 234. More specifically, the first and second beam segments 220, 222 have a generally non-orthogonal orientation with respect to the base section 202 or with respect to the seat portion 234. The first and second beam segments 220, 222 extend in an oblique direction 244 away from the base section 202 or the bottom surface 232.

Figure 9:
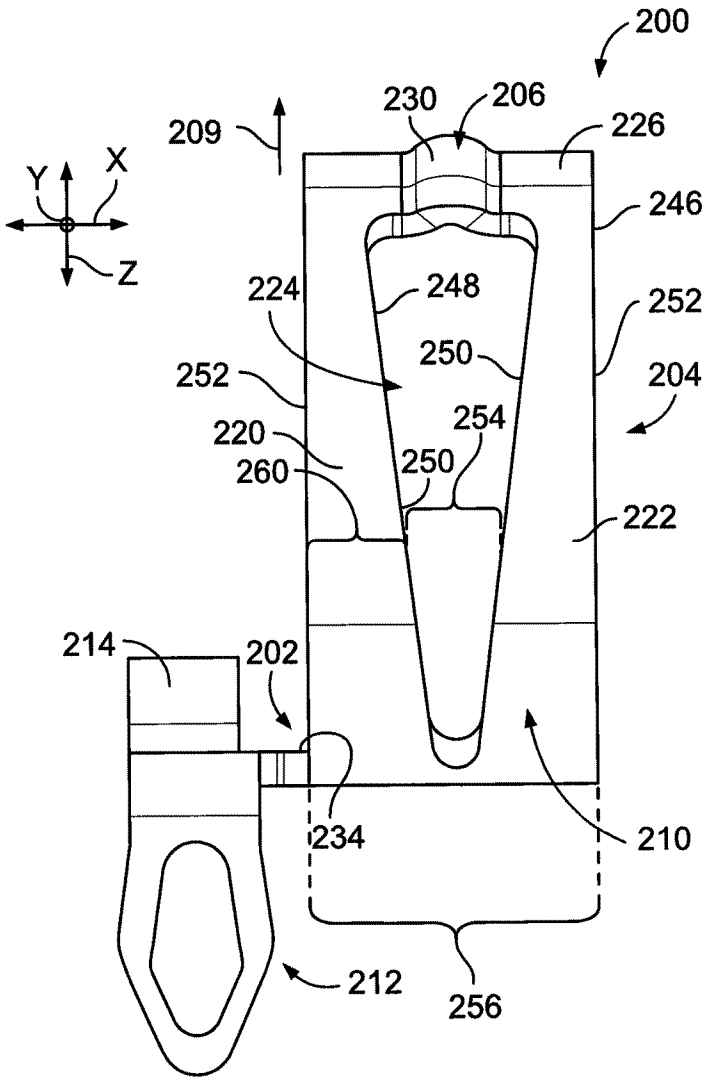
FIG. 9 is a back view of the spring contact of FIG. 6.

Turning to FIG. 9, the spring contact 200 has an outer contact edge 246 and an interior slot edge 248. The contact slot 224 is defined by the interior slot edge 248. Each of the first and second beam segments 220, 222 has an inner edge portion 250 and an outer edge portion 252. In the illustrated embodiment, the inner edge portions 250 are portions of the interior slot edge 248, and the outer edge portions 252 are portions of the outer contact edge 246. The inner edge portions 250 are hereinafter referred to as the inner edges, and the outer edge portions 252 are hereinafter referred to as the outer edges.

Each of the first and second beam segments 220, 222 has a beam width 260 that is defined between the respective inner edge 250 and the respective outer edge 252. The beams widths 260 decrease along the inclined section 204 as the first and second beam segments 220, 222 extend in the oblique direction 244 (FIG. 10). The inner edges 250 of the first and second beam segments 220, 222 generally oppose each other with the contact slot 224 therebetween. The contact slot 224 has a slot width 254 that is defined between the inner edges 250 of the first and second beam segments 220, 222. The slot width 254 increases along the inclined section 204 as the first and second beam segments 220, 222 extend in the oblique direction 244 (FIG. 10). Unlike the slot width 154 (FIG. 5), the slot width 254 changes continuously. For example, the slot width 254 increases at a linear rate from a beginning of the contact slot 224 at the joint 210 to an end of the contact slot 224 at the contact bridge 226.

Also shown in FIG. 9, the outer edges 252 of the first and second beam segments 220, 222 define a maximum width 256 of the inclined section 204 therebetween. The maximum width 256 of the inclined section 204 is essentially constant as the inclined section 204 extends from the joint 210 to the contact bridge 226. The base section 202 may have the same maximum width 256 for at least a portion of the base section 202. In particular embodiments, the maximum width 256 is essentially constant as the inclined section 204 extends in the oblique direction 244 (FIG. 10) and as the slot width 254 increases. For example, the maximum width 256 is maintained for the entire inclined section 204.

For at least a portion of the spring contact 200, the maximum width 256 may be essentially constant as the slot width 254 increases. As such, the inclined section 204 may have a material width, as described above with respect to FIG. 5, that decreases as the first and second beam segments 220, 222 extend in the oblique direction 244 (FIG. 10).

Although embodiments described herein include inclined sections having a maximum width that is essentially constant, it should be understood that other embodiments may include inclined sections with widths that are not constant and taper slightly (e.g., decrease slightly). For example, the inclined sections may have widths that taper at a rate that is smaller than a taper rate of conventional spring contacts. Such inclined sections may include contact slots that are similar to the contact slots described herein. Similar to the inclined sections 104 (FIG. 1) and 204 (FIG. 6), these alternative inclined sections with reduced taper rates may facilitate minimizing an impedance discontinuity.

Figure 11:
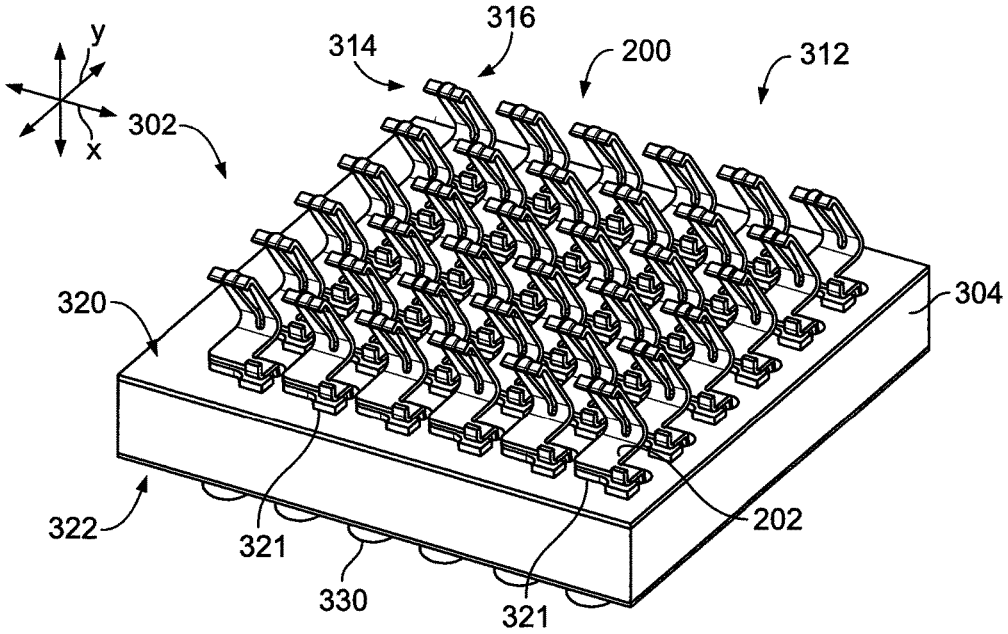
FIG. 11 is a perspective view of an interposer socket that includes a base substrate having an array of the spring contacts shown in FIG. 6.
Figure 12:
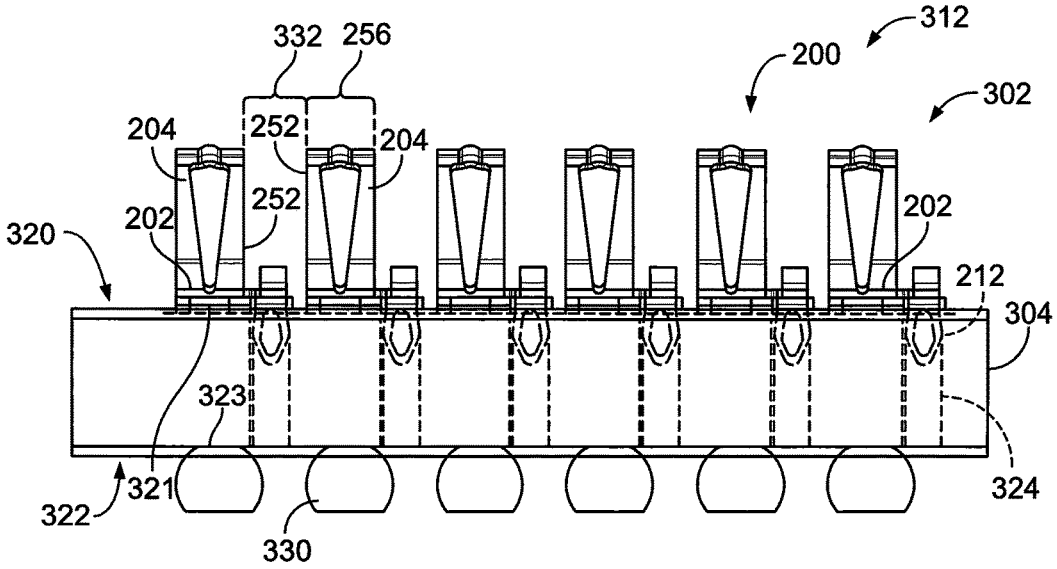
FIG. 12 is a side view of the interposer socket of FIG. 11.

FIG. 11 is a perspective view of an interposer socket 302 formed in accordance with an embodiment, and FIG. 12 is a side view of the interposer socket 302. The interposer socket 302 includes a base substrate 304 and a plurality of the spring contacts 200. The base substrate 304 has opposite top and bottom sides 320, 322. In the illustrated embodiment, the spring contacts 200 are coupled to the top side 320 and surface-mount electrical contacts 330 (e.g., solder balls) are coupled to the bottom side 322. As shown, each and every spring contact along the top side 320 is the spring contact 200. In other embodiments, however, the spring contacts 200 may be among other spring contacts that are configured or shaped differently.

The plurality of the spring contacts 200 form an array 312 along the top side 320. The array 312 may include a plurality of columns 314 in which each column 314 has a series of spring contacts 200 that are aligned with one another along the X axis. The array 312 may also include a plurality of columns 316 in which each column 316 has a series of spring contacts 200 that are aligned with one another along the Y axis. The spring contacts 200 may be equi-spaced within each of the columns 314, 316.

In the illustrated embodiment, the base substrate 304 includes a printed circuit board (PCB). The base substrate 304 may be fabricated in a similar manner as PCBs. For instance, the base substrate 304 may include a plurality of stacked layers of dielectric material and may also include conductive pathways through the stacked layers that are formed from vias, plated thru-holes, conductive traces, and the like. The base substrate 304 may be fabricated from and/or include any material(s), such as, but not limited to, ceramic, epoxy-glass, polyimide (e.g., Kapton® and the like), organic material, plastic, and polymer.

The base substrate 304 has thru-holes 324 (FIG. 12) that are sized and shaped to receive respective compliant pins 212 (FIG. 12) of the spring contacts 200. For example, the top side 320 has a plurality of conductive surfaces 321 (e.g., conductive pads) arranged thereon, and the bottom side 322 also has a plurality of conductive surfaces 323 (FIG. 12) arranged thereon. The conductive surfaces 321 are electrically coupled to the conductive surface 323 through conductive pathways (not shown) of the base substrate 304. The conductive pathways may include traces and/or vias (not shown). The base sections 202 of the spring contacts 200 are mechanically and electrically coupled (e.g., soldered) to the conductive surfaces 321. The electrical contacts 330 may also be mechanically and electrically coupled (e.g., soldered) to the conductive surfaces 323.

Figure 6:
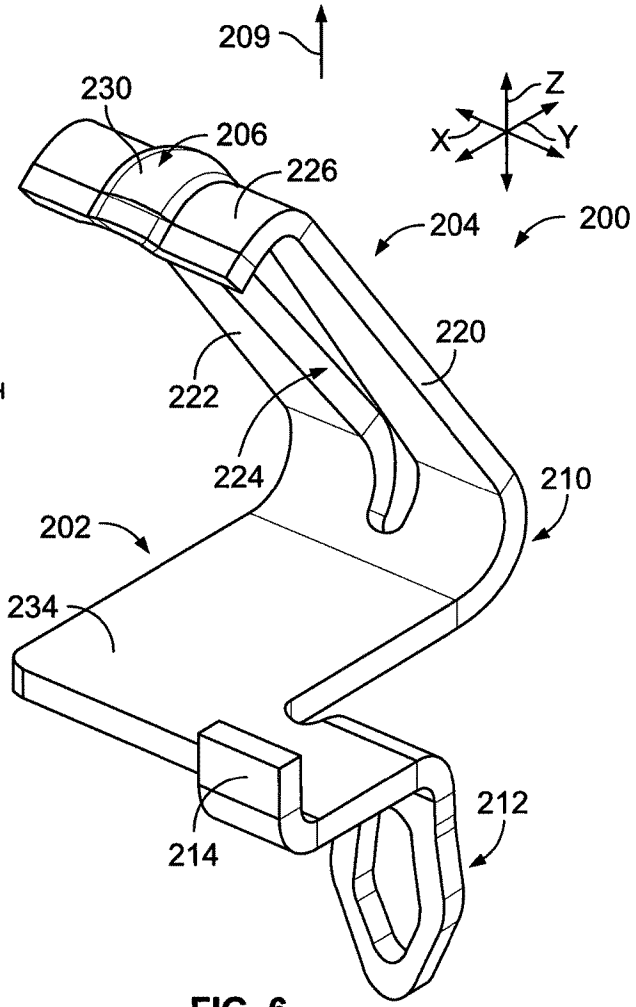
FIG. 6 is a front perspective view of a spring contact in accordance with an embodiment.

In other embodiments, however, the interposer socket 302 does not include solder balls 330 and/or the base substrate 304 is not a PCB having conductive pathways. For instance, in other embodiments, the base substrate may be a dielectric frame that is configured to engage and support the spring contacts. In such embodiments, each of the spring contacts may extend through passages of the frame and form an entire conductive pathway. For example, each of the spring contacts may have a first inclined section and a second inclined section that extend in opposite directions. The first and second inclined sections may be similar or identical to the inclined sections 104 (FIG. 1) or the inclined sections 204 (FIG. 6). The first inclined sections may be configured to engage an electronic module along the top side, and the second inclined sections may be configured to engage another electrical component along the bottom side.

With specific reference to FIG. 12, adjacent inclined sections 204 of at least some of the spring contacts 200 may form working gaps 332 between corresponding outer edges 252 of the adjacent inclined sections 204. For embodiments in which the maximum width 256 is essentially constant, the working gaps 332 may also be essentially constant between the corresponding outer edges 252 of the adjacent inclined sections 204. In such embodiments, the working gaps 332 between adjacent spring contacts 200 or inclined sections 204 may be reduced thereby reducing an amount of air that surrounds the spring contacts 200. Air has a lower dielectric constant than the contact material of the spring contacts 200. Accordingly, the impedance may be reduced by reducing the size of the working gaps 332.

Figure 13:
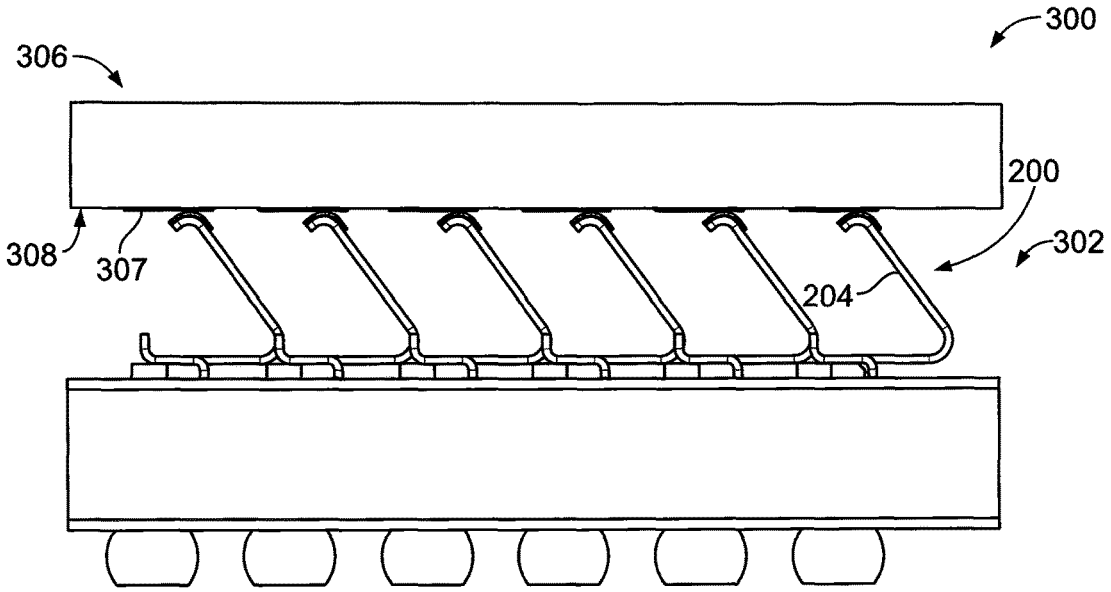
FIG. 13 is a side view of a connector assembly in accordance with an embodiment in which an electronic module is poised to be mounted onto the interposer socket of FIG. 11.
Figure 14:
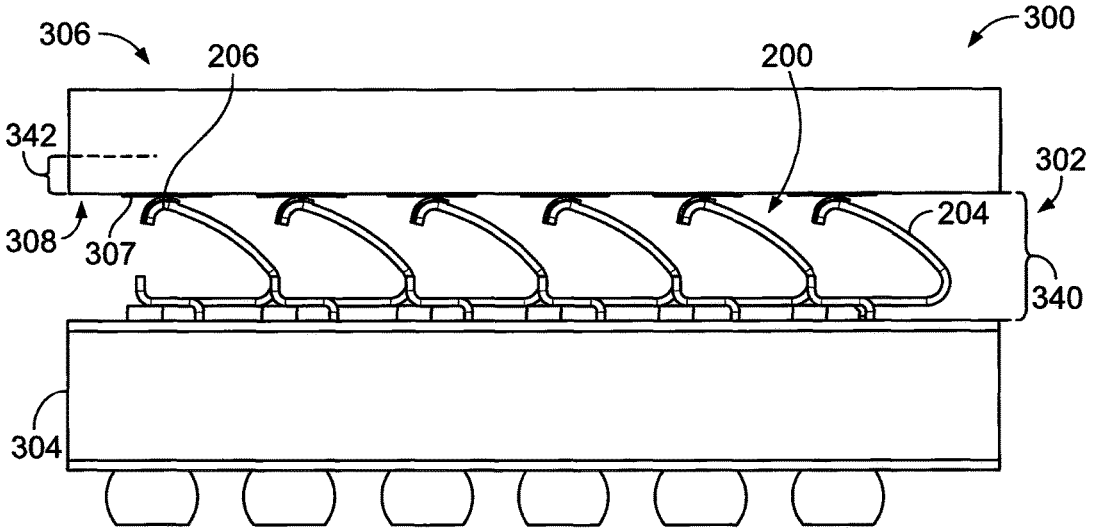
FIG. 14 is a side view of a connector assembly in which the electronic module is mounted to the interposer socket of FIG. 11 such that each spring contact is in a deflected state.

FIGS. 13 and 14 are side views of a connector assembly 300 in accordance with an embodiment. The connector assembly 300 includes the interposer socket 302 and an electronic module 306 having contact pads 307 along a bottom module side 308. In some embodiments, the electronic module 306 receives input data signals, processes the input data signals, and provides output data signals. The electronic module 306 may be any one of various types of modules, such as a chip, a package, a central processing unit (CPU), a processor, a memory, a microprocessor, an integrated circuit, a printed circuit, an application specific integrated circuit (ASIC), an electrical connector, and/or the like.

In FIG. 13, the electronic module 306 is poised for being mounted onto the spring contacts 200. FIG. 14 illustrates the connector assembly 300 when operably assembled. More specifically, the contact pads 307 are engaged to respective mating surfaces 206 of the spring contacts 200. The inclined sections 204 of the spring contacts 200 are in compressed states or conditions at a mating region 340 between the electronic module 306 and the base substrate 304.

The spring contacts 200 may also provide desired mechanical properties while reducing the impedance as described above. In particular, the spring contacts 200 may permit the inclined sections 204 to be deflected a distance 342 when a designated mounting force is applied. If the inclined sections were solid and devoid of the contact slots, the spring contacts may not be deflectable. The varying slot width 254 (FIG. 9) of the contact slot 224, however, reduces the amount of material that resists deflection. Accordingly, the spring contacts 200 may achieve desired mechanical properties and reduce impedance.

Figure 15:
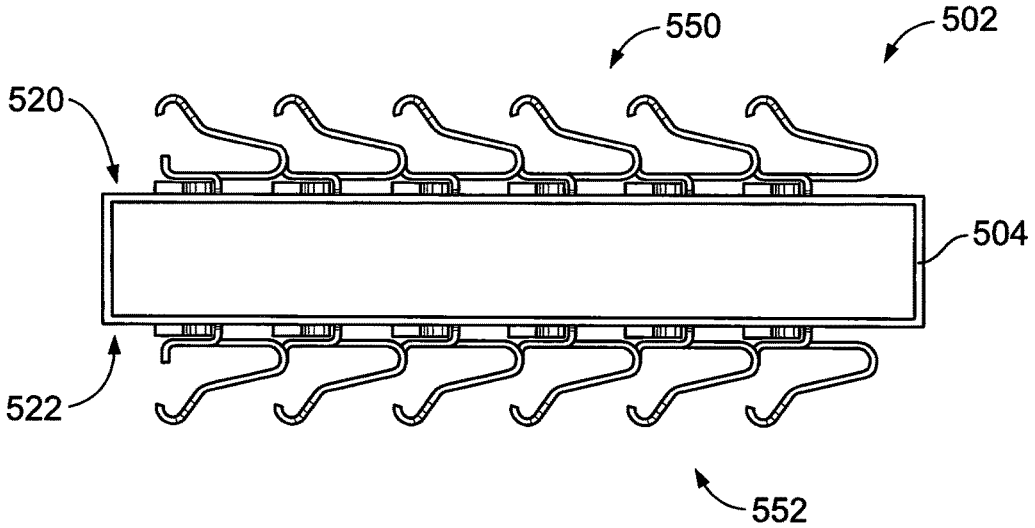
FIG. 15 is a side view of the interposer socket of FIG. 11.

FIG. 15 is a side view of an interposer socket 502 formed in accordance with an embodiment. As shown, the interposer socket 502 includes a base substrate 504 and a plurality of the spring contacts 550 and a plurality of spring contacts 552. The base substrate 504 has opposite top and bottom sides 520, 522. In the illustrated embodiment, the spring contacts 550 are coupled to the top side 520, and the spring contacts 552 are coupled to the bottom side 522. The spring contacts 550 and 552 may be the same type or different types of spring contacts. The spring contacts 552 are configured to engage an electrical component (e.g., circuit board), and the spring contacts 550 are configured to engage an electronic module.

Figure 16:
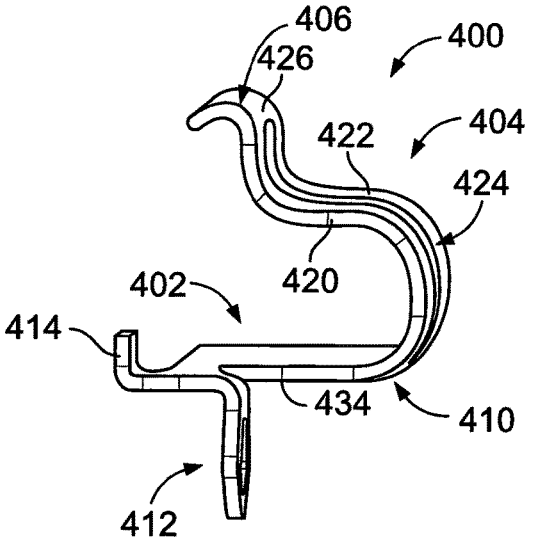
FIG. 16 is a perspective view of a spring contact in accordance with an embodiment.
Figure 17:
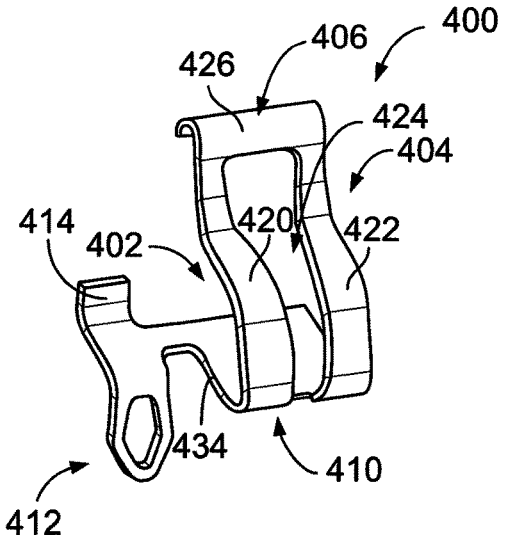
FIG. 17 is another perspective view of the spring contact of FIG. 16.

FIGS. 16 and 17 illustrate different views of a spring contact 400 in accordance with an embodiment. The spring contact 400 may include features that are similar or identical to the spring contact 100 (FIG. 1) and the spring contact 200 (FIG. 6). For example, the spring contact 400 includes a base section 402 and an inclined section 404. As shown, the inclined section 404 is not required to be planar, but may have a generally non-orthogonal orientation with respect to the base section 402. The inclined section 404 has a mating surface 406 that is configured to engage an electrical contact (e.g., contact pad) of an electronic module (not shown). The base section 402 and the inclined section 404 are coupled to each other at a joint 410. As shown, the base section 402 includes a compliant pin 412 that is similar or identical to the compliant pin 112 (FIG. 1) or the compliant pin 212 (FIG. 6). The base section 402 may also include a strip remnant 414.

The spring contact 400 also includes a first beam segment 420 and a second beam segment 422 that are separated by a contact slot 424 therebetween. The first and second beam segments 420, 422 form a portion of the inclined section 404 and a portion of the joint 410. Unlike the first and second beam segments 120, 122 (FIG. 1), the first and second beam segments 420, 422 do not form a portion of the base section 402. The base section 402 includes a seat portion 434, the compliant pin 412, and the remnant 414. The seat portion 434 has a planar body that is configured to be mounted onto a top side (not shown) of a base substrate. The spring contact 400 does not include a mating ridge or finger. Instead, the spring contact 400 includes a contact bridge 426 that is shaped to form the mating surface 406. The contact bridge 426 connects the first and second beam segments 420, 422. As shown in FIG. 17, the contact slot 424 has a slot width that increases as the contact slot 424 extends in an oblique direction away from the joint 410.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. An interposer socket comprising:

a base substrate having opposite top and bottom sides; and a plurality of spring contacts coupled to the base substrate, each of the spring contacts having a base section and an inclined section coupled to the base section, the base section including a seat portion that is mounted onto the top side of the base substrate, the inclined section extending away from the base section and having a generally non-orthogonal orientation with respect to the top side and the seat portion, the inclined section configured to be deflected toward the top side when an electronic module is mounted onto the interposer socket;

wherein the inclined section has a mating surface that is configured to engage the electronic module, the inclined section including first and second beam segments and a contact slot therebetween, the first and second beam segments extending in an oblique direction away from the top side, the contact slot having a slot width that is defined between inner edges of the first and second beam segments, the slot width increasing as the contact slot extends in the oblique direction.

2. The interposer socket of claim 1, wherein the first and second beam segments have outer edges that define a maximum width of the inclined section therebetween, the maximum width of the inclined section being essentially constant as the slot width increases.

3. The interposer socket of claim 2, wherein the inclined section has a material width measured between the outer edges, the material width representing a width of contact material of the first and second beam segments less the contact slot therebetween, the material width decreasing as the slot width increases.

4. The interposer socket of claim 1, wherein the first and second beam segments have outer edges that define a maximum width of the inclined section therebetween, the inclined sections of the spring contacts being arranged above the top side, wherein each of the outer edges is spaced apart from an opposing outer edge of an adjacent inclined section with a working gap therebetween, the working gap being essentially constant between the opposing outer edges, the working gap between the outer edges for an entirety of the adjacent inclined sections including only air.

5. The interposer socket of claim 1, wherein the first and second beam segments have respective beam widths, the beam widths of the first and second beam segments decreasing as the first and second beam segments extend in the oblique direction.

6. A connector assembly that includes the interposer socket of claim 1, wherein the connector assembly further comprises the electronic module, the electronic module configured to receive input data signals, process the input data signals, and provide output data signals, the interposer socket capable of transmitting data at a data rate of at least 40 gigabits per second (Gbps).

7. The interposer socket of claim 1, wherein the first and second beam segments are joined through a contact bridge, the inclined section also including a mating finger that projects from the contact bridge, the mating finger including the mating surface.

8. An interposer socket comprising:

a base substrate having opposite top and bottom sides; and a plurality of spring contacts coupled to the base substrate, each of the spring contacts having a base section and an inclined section coupled to the base section, the base section including a seat portion that is mounted onto the top side of the base substrate, the inclined section extending away from the base section and having a generally non-orthogonal orientation with respect to the top side and the seat portion, the inclined section configured to be deflected toward the top side when an electronic module is mounted onto the interposer socket;

wherein the inclined section has a mating surface that is configured to engage the electronic module, the inclined section including first and second beam segments and a contact slot therebetween, the first and second beam segments extending in an oblique direction away from the top side, the base section also including the first and second beam segments and the contact slot therebetween;

wherein the first and second beam segments are joined through a contact bridge that includes the mating surface or is proximate to the mating surface, the first and second beam segments also being joined through the base section, the contact slot extending directly between the contact bridge and the base section, wherein the contact slot has a non-linear path in which a first slot portion of the contact slot extends in the oblique direction and a second slot portion of the contact slot extends along the top side of the base substrate.

9. The interposer socket of claim 8, wherein the contact bridge is a first contact bridge, the first and second beam segments being joined through a second contact bridge that is mounted onto the top side of the base substrate, the contact slot extending between the first contact bridge and the second contact bridge, the first slot portion extending away from the first contact bridge along the inclined section and then curving such that the second slot portion extends toward the second contact bridge of the base section.

10. The interposer socket of claim 8, wherein the second slot portion extends parallel to the top side.

11. The interposer socket of claim 8, wherein the base section includes a contact edge mounted to the top side, the contact edge facing in a lateral direction that is parallel to the top side, the first and second beam segments extending directly from the contact edge, each of the spring contacts having a compliant tail that extends directly from the contact edge.

12. The interposer socket of claim 8, wherein the mating surface engages the electronic module at a mating interface, the mating interface occurring above the base section such that a line that is perpendicular to the top side is extendable from the base section to the mating interface.

13. An interposer socket comprising:

a base substrate having opposite top and bottom sides;

a plurality of spring contacts coupled to the base substrate, each of the spring contacts having a base section and an inclined section coupled to the base section, the base section including a seat portion that is mounted onto the top side of the base substrate, the inclined section extending away from the base section and having a generally non-orthogonal orientation with respect to the top side and the seat portion, the inclined section configured to be deflected toward the top side when an electronic module is mounted onto the interposer socket;

wherein the inclined section has a mating surface of the spring contact that is configured to engage the electronic module, the inclined section includes first and second beam segments and a contact slot therebetween, the first and second beam segments having respective outer edges and extending in an oblique direction away from the top side, wherein a maximum width of the inclined section is defined between the outer edges, the maximum width being essentially constant for at least a majority of the inclined section;

wherein the base substrate includes a thru-hole that extends into the base substrate and opens to the top side, the base section of the spring contacts including a compliant pin, the compliant pin being inserted into the thru-hole and mechanically coupling the spring contact to the base substrate, but not electrically coupling the spring contact to the base substrate for communicating through the compliant pin and the base substrate.

14. The interposer socket of claim 13, wherein the contact slot has a slot width that is defined between inner edges of the first and second beam segments, the slot width increasing as the contact slot extends in the oblique direction.

15. The interposer socket of claim 13, wherein the inclined section has a material width measured between the outer edges, the material width representing a width of contact material of the first and second beam segments less the contact slot, the material width decreasing as the slot width increases.

16. The interposer socket of claim 13, wherein the inclined sections are aligned in a row along the top side, wherein each of the outer edges is spaced apart from an opposing outer edge of an adjacent inclined section with a working gap therebetween, the working gap being essentially constant between the opposing outer edges.

17. The interposer socket of claim 13, wherein the first and second beam segments have respective beam widths, the beam widths of the first and second beam segments decreasing as the first and second beam segments extend in the oblique direction.

18. The interposer socket of claim 13, wherein the first and second beam segments are joined through a contact bridge that includes the mating surface or is proximate to the mating surface, the first and second beam segments also being joined through a base section, the contact slot extending directly between the contact bridge and the base section.

19. The interposer socket of claim 13, wherein the base substrate comprises a circuit board having conductive surfaces positioned along the top and bottom sides, the conductive surfaces along the top side being mechanically and electrically coupled to respective spring contacts and electrically coupled to respective conductive surfaces along the bottom side.

20. The interposer socket of claim 13, wherein the base substrate includes conductive pads along the top side, the seat portions being mechanically and electrically coupled to the conductive pads.

* * * * *